United States Patent [19]

Matula

[11] Patent Number: 5,056,538

[45] Date of Patent: Oct. 15, 1991

[54] HAIR COLORING DEVICE AND METHOD

[76] Inventor: Allan Matula, 185 Meisel Ave., Springfield, N.J. 07981

[21] Appl. No.: 452,252

[22] Filed: Dec. 18, 1989

[51] Int. Cl.[5] ..... A61K 7/13

[52] U.S. Cl. ..... 132/208; 132/222; 132/270

[58] Field of Search ..... 132/202, 207, 208, 222, 132/270

[56] References Cited

U.S. PATENT DOCUMENTS

| | | | |
|---|---|---|---|
| 2,991,790 | 7/1961 | Bonilla | 132/207 |
| 3,109,438 | 11/1963 | Work | 132/222 |
| 3,349,781 | 10/1967 | Poole et al. | 132/208 |
| 3,548,842 | 12/1970 | McCall | 132/222 |
| 4,224,954 | 9/1980 | Stahl | 132/208 |
| 4,672,983 | 6/1987 | Nath et al. | 132/208 |

FOREIGN PATENT DOCUMENTS

| | | | |
|---|---|---|---|
| 0126618 | 11/1984 | European Pat. Off. | 132/208 |

*Primary Examiner*—John J. Wilson
*Assistant Examiner*—Frank A. LaViola
*Attorney, Agent, or Firm*—Richard T. Laughlin

[57] ABSTRACT

A hair coloring device and method are provided. The device includes a plurality of foldable, clear, plastic strips, each having a center portion and a left portion and a right portion. The left and right portions are folded over to form a passage therethrough with top and bottom openings for ventilation. The passage contains a hair section having a plurality of hair strands. The device also includes a coloring agent or bleach disposed on each hair section. The method includes the steps of, separating the hair of a person into hair sections; placing the hair sections on respective strips; applying bleach to each of the hair sections; and folding over each of the strips forming a passage for enclosing the respective hair section and forming top and bottom passage openings for ventilating the passage.

3 Claims, 1 Drawing Sheet

HAIR COLORING DEVICE AND METHOD

The invention generally relates to a hair coloring device and method and in particular the invention relates to a hair coloring device having a self ventilating air passage.

BACKGROUND OF THE INVENTION

The prior art hair coloring device and method is described in U.S. Pat. No. 4,637,411, issued Jan. 20, 1987. Related patents include U.S. Pat. Nos. 3,452,759, issued July 1, 1969, 3,941,613, issued Mar. 2, 1976, 4,144,987, issued Mar. 20, 1979, and 4,224,954, issued Sept. 30, 1980.

The prior art hair coloring device includes a plurality of folded strips which are used to color hair sections respectively having a plurality of hair strands and includes an adhesive material disposed within each folded strip.

One problem with the prior art hair coloring device is that the adhesive material adheres to some hair strands and removal of the device causes some discomfort to the person. Another problem is that overheating within the closed strip sometimes occurs thereby causing overheating of the hair.

SUMMARY OF THE INVENTION

According to the present invention, a hair coloring device is provided. This device comprises at least one strip having a center portion and a left portion and a right portion, said left and right portions being folded over to form a passage therethrough and to form a top opening, said passage and said top opening being aligned for enclosing a section of hair having a plurality of hair strands; and a bleach disposed on the hair strands for coloring the hair strands.

By using the folded strip having a passage with an outlet opening, overheating of the hair is avoided. Also, due to the avoidance of adhesive, discomfort to the person during removal of the strip is avoided.

The foregoing and other objects, features and advantages will be apparent from the following description of the preferred embodiment of the invention as illustrated in the accompanying drawings.

DESCRIPTION OF THE PREFERRED EMBODIMENT

Figure 1:
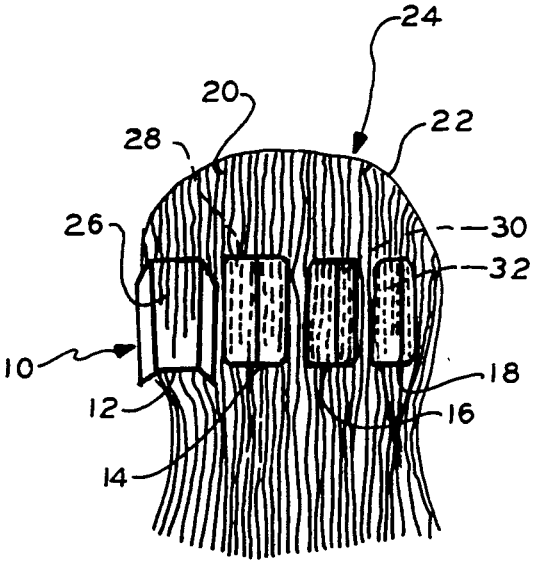
FIG. 1 is an elevation view of the device according to the invention.

As shown in FIG. 1, a device or assembly 10 for coloring hair is provided. Device 16 includes a plurality of sheets or strips 12, 14, 16, 18, which are used to color hair 20 of head 22 of person 24. Hair 20 is formed in respective sections 26, 28, 30, 32.

Figure 2:
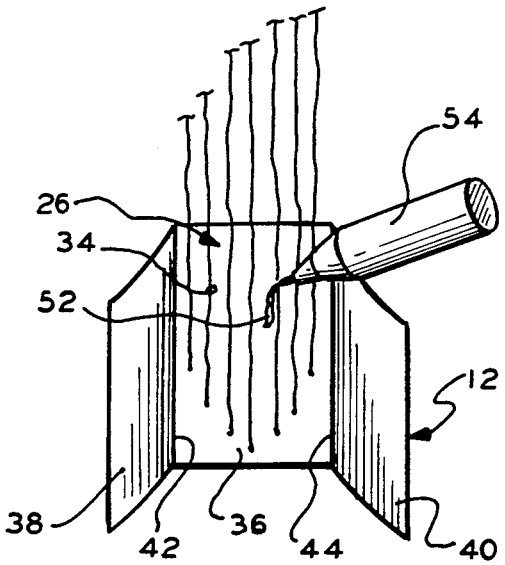
FIG. 2 is an enlarged view of a portion of FIG. 1.

As shown in FIG. 2, typical section 26 has a plurality of strands 34. Strip 12, which is identical to strips 14, 16, 18, has a center portion 36, a left portion 38, and a right portion 40. Strip 12 also has a left crease line 42 and a right crease line 44.

Figure 3:
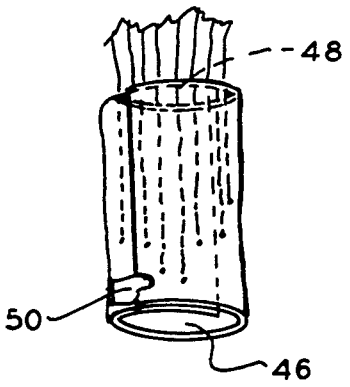
FIG. 3 is an enlarged view of the portion of FIG. 2 in a closed condition.

As shown in FIG. 3, strip 12, when closed over, has a bottom opening 46, a top opening 48, and an air passage or chamber 50. Coloring or bleach 52, which is in a liquid form, and which may be in a paste form, is applied to the hair strands 34, using an applicator 54, such as a squeeze-type bottle, or a cotton square, or the like.

Openings 46, 48 allow a natural ventilation or air flow through passage 50, thereby preventing an overheating, or baking, of hair strands 34. The heat is due in part to a chemical reaction of bleach 52.

Strip 12 is composed of a plastic material which is a foldable and self-creasing material, for one-hand folding thereof. Strip material is a clear or transparent material for viewing the hair strands 34 within passage 50 at time intervals during the blonding or bleaching. Strip material is relatively non-insulating for avoiding an overheating and for assuring an optimum final condition of hair section 26. Strip 12 is relatively lightweight for preventing a falling thereof due to gravity force.

The method, or process, or technique, of hair coloring includes the steps as indicated hereafter.

First, hair 20 is separated into sections 26, 28, 30, 32.

Second, sections 26, 28, 30, 32 are placed on respective strips 12, 14, 16, 18, disposed in an open condition.

Third, bleach 52 is applied to the hair strands 34, as selected, of sections 26, 28, 30, 32, which are disposed on respective strips 12, 14, 16, 18.

Fourth, each of the strips 12, 14, 16, 18 is folded over in order to enclose respective sections 26, 28, 30, 32.

Fifth, creases 42, 44 are made by hand and disposed approximately parallel to hair strands 34.

Sixth, strands 34 are inspected at selected time intervals to assure that a desired hair color level is obtained.

Seventh, strips 12, 14, 16, 18 are removed, without discomfort to person 24, after coloring is completed.

The advantages of device 10 as compared to a prior art device are indicated hereafter.

A) Strips 12, 14, 16, 18 do not create heat, so that the hair is not baked leaving the hair in a relatively better condition.

B) Strips 12, 14, 16, 18 can be used over again by simply washing them in soapy, warm water for minimizing cost.

C) Bleach 52 is used in relatively smaller quantities for minimizing cost.

D) Hair 20 is left in a healthier condition due to the need for a relatively lower quantity or volume of bleach.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. In a method of coloring a section of hair having a plurality of hair strands utilizing a heat generating coloring agent, including the steps of forming the section of hair having the plurality of hair strands; placing the section of hair on a plastic strip having a center portion and a left portion and a right portion with the left portion and the right portion in an open condition; and applying the heat generating coloring agent to the hair strands disposed on the center portion; the improvement which comprises folding over the left and right portions for enclosing the hair strands to form a heat conducting air passage between the hair and the folded plastic strip.

2. The method of claim 1, including the steps of utilizing a transparent plastic strip, forming two crease lines between the center portion and the respective left and right portions of the strip during the folding thereof; inspecting the hair strands through the transparent strip at selected time intervals after applying the coloring agent; and opening the left and right portions and removing the strip from the hair strands after a desired color level is achieved.

3. A method of coloring a section of hair, including the steps of: separating hair on the head of a person into hair sections each having a plurality of strands; placing the hair sections respectively on a plurality of transparent plastic strips; applying a heat generating bleach to the hair sections in a selective manner; folding over each of the strips over the respective hair sections forming respective heat conducting passages with respective top openings for ventilation; inspecting the hair sections at selected time intervals until each desired hair color level is achieved; and unfolding the strips and removing the strips from the hair sections.

* * * * *